United States Patent [19]

Nayfa et al.

[11] 4,000,536

[45] Jan. 4, 1977

[54] FLOOR CLEANING MACHINE WITH FOAM DISPENSING SYSTEM

[76] Inventors: James E. Nayfa, 5015 Sharp St., Dallas, Tex. 75247; Andrew D. Stanley, 2306 Cedar Way Drive, Dallas, Tex. 75241

[22] Filed: Jan. 8, 1976

[21] Appl. No.: 647,503

Related U.S. Application Data

[62] Division of Ser. No. 390,023, Aug. 20, 1973, Pat. No. 3,931,662, which is a division of Ser. No. 147,866, May 28, 1971, Pat. No. 3,761,987.

[52] U.S. Cl. ..... 15/50 A; 15/320; 15/380

[51] Int. Cl.[2] ..... A47L 11/284; A47L 11/30; A47L 11/34

[58] Field of Search ..... 15/50 R, 50 C, 50 A, 15/320, 340, 380

[56] References Cited

UNITED STATES PATENTS

| | | | |
|---|---|---|---|
| 551,773 | 12/1895 | LeClerc | 15/50 R |
| 2,198,322 | 4/1940 | Von Schrader | 15/50 R X |
| 2,334,914 | 11/1943 | Erickson | 15/320 X |
| 2,731,659 | 1/1956 | Coplen | 15/380 X |
| 3,061,859 | 11/1962 | Dubay | 15/50 C |
| 3,430,280 | 3/1969 | Arones | 15/50 C |
| 3,633,240 | 1/1972 | Crener et al. | 15/321 |

FOREIGN PATENTS OR APPLICATIONS

| | | | |
|---|---|---|---|
| 89,188 | 4/1967 | France | 15/50 R |

*Primary Examiner*—Christopher K. Moore
*Attorney, Agent, or Firm*—Peter J. Murphy

[57] ABSTRACT

A self-propelled machine includes a main housing supported on front and rear drive rollers and has an operator control handle extending from the rear. Front and rear elongated working brushes are driven in orbital movement in horizontal planes, with the front brush being positioned ahead of the front roller and the rear brush position behind the rear roller. A pressurized supply tank for the working solution includes agitating and aerating means for creating a foam, and includes an adjustable control gate for controlling the flow of foam through dispensing passages to the floor surfaces ahead of the front brush. The drive rollers act as squeegees. A collection system includes vacuum pickup nozzles adjacent each of the drive rollers for picking up material from the floor surface, which material is collected in a collection tank.

8 Claims, 15 Drawing Figures

FLOOR CLEANING MACHINE WITH FOAM DISPENSING SYSTEM

REFERENCE TO RELATED APPLICATIONS

This application is a division of application Ser. No. 390,023 filed Aug. 20, 1973, now U.S. Pat. No. 3,931,662, issued Jan. 13, 1976 which application Ser. No. 390,023 is, in turn, a division of application Ser. No. 147,866 filed May 28, 1971, and now U.S. Pat. No. 3,761,987 issued Oct. 2, 1973.

BACKGROUND AND SUMMARY OF THE INVENTION

This invention relates to a machine for scrubbing or shampooing rugs or carpeted floor surfaces, for scrubbing hard floor surfaces, or for waxing and polishing hard floor surfaces.

A variety of machines have been devised for cleaning rugs or carpets through the use of detergents generated and applied in the form of a dry foam in the path of shampooing brushes intended to work the foam into the pile to entrap the dirt held therein, with the foam and entrapped dirt then being extracted from the carpet surface through a vacuum pickup system. A disadvantage of some machines is that the cleaning medium and entrained dirt must be collected in a separate operation. This results in extra work, considerable wetting of the nap surface for more difficult removal of the dirt, and longer drying time.

An object of this invention is to provide an improved floor surface cleaning machine having the capability to shampoo and remove surface dirt from a carpet surface in one operation, to scrub and remove surface dirt from a hard floor surface in one operation, or to apply wax to and polish a floor surface in one operation.

A further object of this invention is to provide a floor surface cleaning machine having a cleaning solution foaming system within the machine and a pressurized foam dispensing system.

Still another object of this invention is to provide a rug cleaning machine having means for scrubbing the pile, removing the dirt from the pile, and lifting the pile to original position in one operation.

Another object of this invention is to provide a rug cleaning machine wherein the machine support and drive rollers function as squeegies to direct the cleaning foam and entrapped dirt toward the vacuum pickup nozzles.

Still another object of this invention is to provide a floor surface cleaning machine having an improved solution dispensing mechanism including means for forming a foam, means for effecting flow of the foam under pressure, and means for controlling the rate of flow of foam to the floor surface.

For accomplishing these objects, a machine according to the invention includes a housing having front and rear ends in relation to normal movement over a floor surface in one direction, and having means supporting the housing for movement along the floor surface. The housing includes supply means for supplying a cleaning medium, including dispensing means disposed at the front thereof; brush means mounted under the housing behind and adjacent to the dispensing means; and power means in the housing for producing movement of the brush means in the floor plane relative to the housing. The cleaning medium supply means includes a supply tank in the housing, having a main chamber for containing a liquid solution. A source of compressed air communicates with the tank main chamber for pressurizing the tank and for aerating the solution to produce a foam of the solution within the main chamber. The tank includes an elongated transverse trough defining a dispensing chamber; and an adjustable gate means for regulating the flow of solution foam from the supply tank main chamber into the dispensing chamber.

The novel features and the advantages of the invention, as well as additional objects thereof, will be understood more fully from the following description when read in connection with the accompanying drawings.

DRAWINGS

DESCRIPTION OF THE PREFERRED EMBODIMENT

Figure 1:
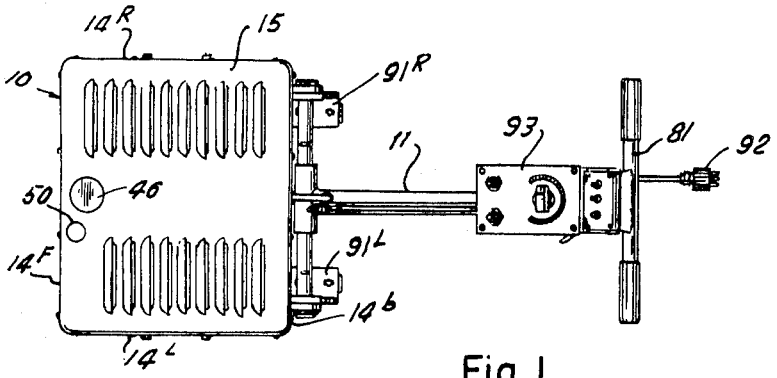
FIGS. 1 through 4 are general views of a preferred form of machine as viewed, respectively, from a top, left side, front and rear of the machine.
Figure 5:
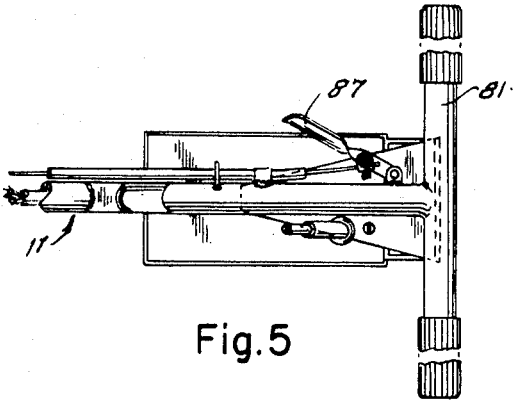
FIGS. 5 and 6 are fragmentary detail views of the machine handle and controls as viewed from the respective planes indicated in FIG. 2.
Figure 2:
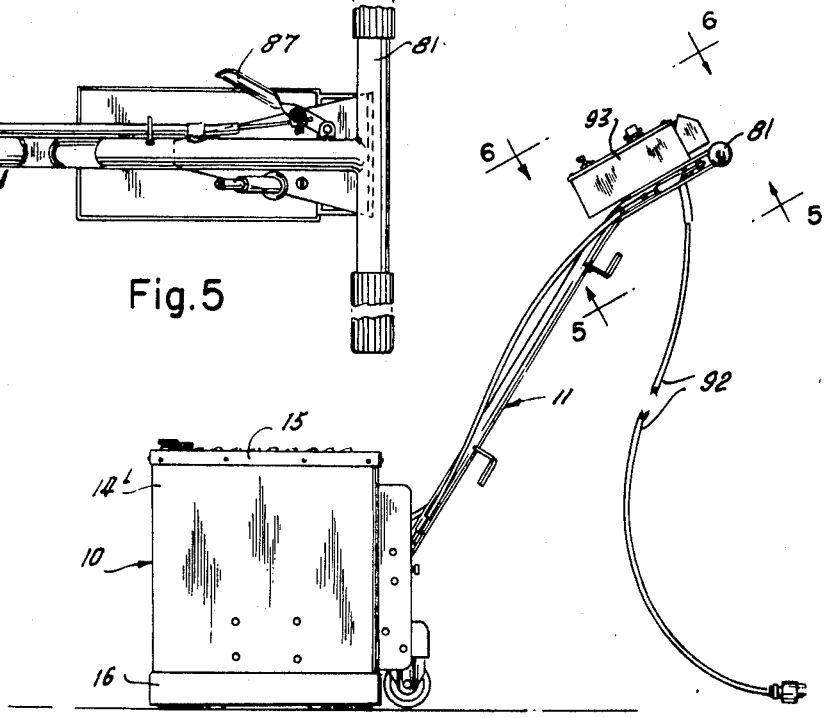

As seen in the drawings, the machine is enclosed in a generally cube shaped housing 10, the machine being self-propelled; and a control handle 11 is attached to the rear wall of the housing by means of which the machine may be manually guided by the operator to the extent necessary, the handle also having various controls mounted thereon for automatic control by the operator.

The machine housing or frame 10 is an integrated structure including a floor plate 13 and rear, left side, front, and right side walls 14B, 14L, 14F and 14R, respectively. As viewed in plan in FIG. 1, the handle 11 is attached to the rear wall of the machine which, in normal forward operation, moves from right to left as viewed in this figure. The references to left and right sides of the machine are considered from the vantage point of the operator at the handle 11. A top cover 15, best seen in FIGS. 1 and 9, encloses the top of the housing and is removable for servicing. As will be described, the housing 10 is supported somewhat above the floor surface, and a flexible skirt 16 defines a downward extension of the housing walls terminating close to the floor surface.

Figure 11:
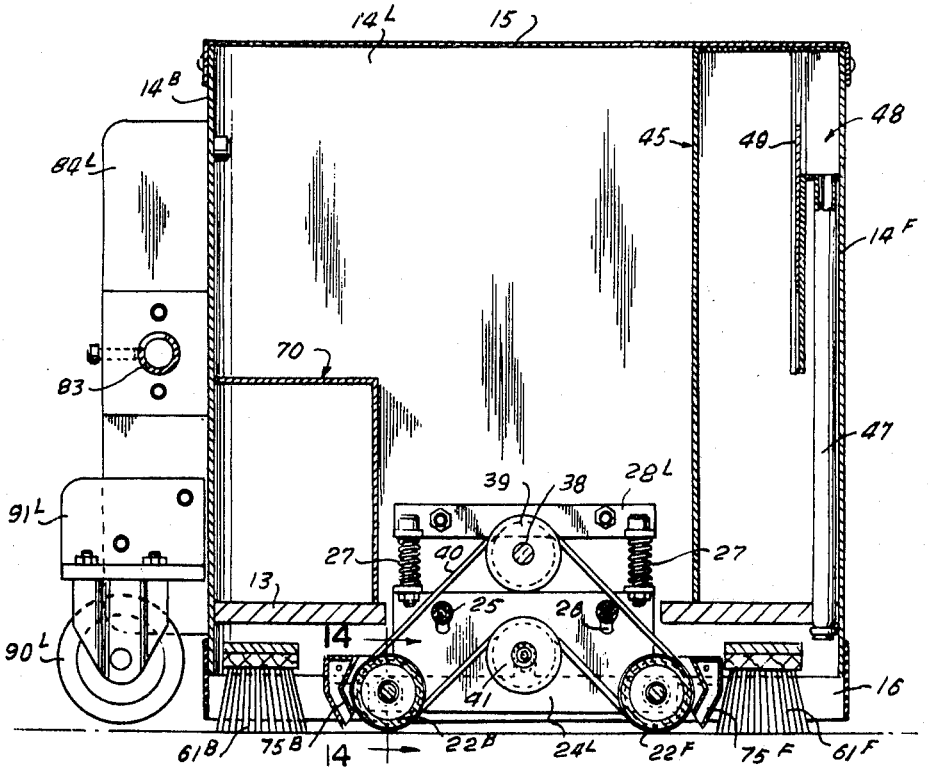
FIG. 11 is a vertical sectional view taken in the plane 11—11 of FIG. 8 adjacent to the left side wall as viewed from the right side of the machine.
Figure 12:
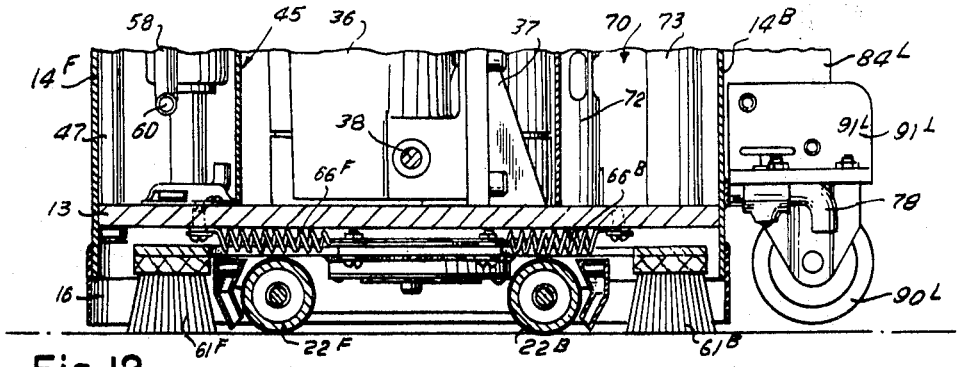
FIG. 12 is a fragmentary sectional view taken in the vertical plane 12—12 of FIG. 7 particularly illustrating the brush supporting mechanism.

The machine is supported and propelled by front and rear drive rollers 22F and 22B rotatably supported in left and right roller brackets 24L and 24R respectively which are floatingly attached to the left and right sidewalls 14L and 14R respectively. As best seen in FIG. 11, the roller bracket 24L is supported for vertical floating movement relative to the wall 14L by means of supporting bolts 25 extending through vertically elongated slots 26 in the roller bracket. The roller brackets 24 then define a form of chassis for the machine; and the housing 10 is supported on the chassis by means of compression springs 27 confined between load bearing ears on the wheel brackets 24 and load bearing pads on load brackets 28L and 28R secured to the sidewalls 14L and 14R respectively. In this manner, the housing 10 is resiliently supported on the chassis defined by the roller brackets 24L and 24R.

Figure 14:
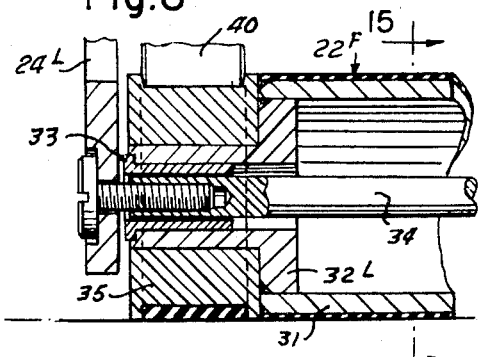
FIG. 14 is a fragmentary sectional view of a drive roller and associated support bracket as viewed in the plane 14—14 of FIG. 11.

As best seen in FIG. 14, each of the rollers 22 comprises a welded structure of an elongated cylindrical tube 31 having a resilient surface layer, and left and right hub structures 32L and 32R respectively. The hub structures include axial bores for retaining sleeve type bushings 33 by means of which the rollers are rotatably supported on elongated shafts 34 which extend between and are suitably secured to the roller brackets 24L and 24R. For driving the rollers, belt pulleys 35 are secured to the hubs 32L at the left ends of the two drive rollers.

Figure 8:
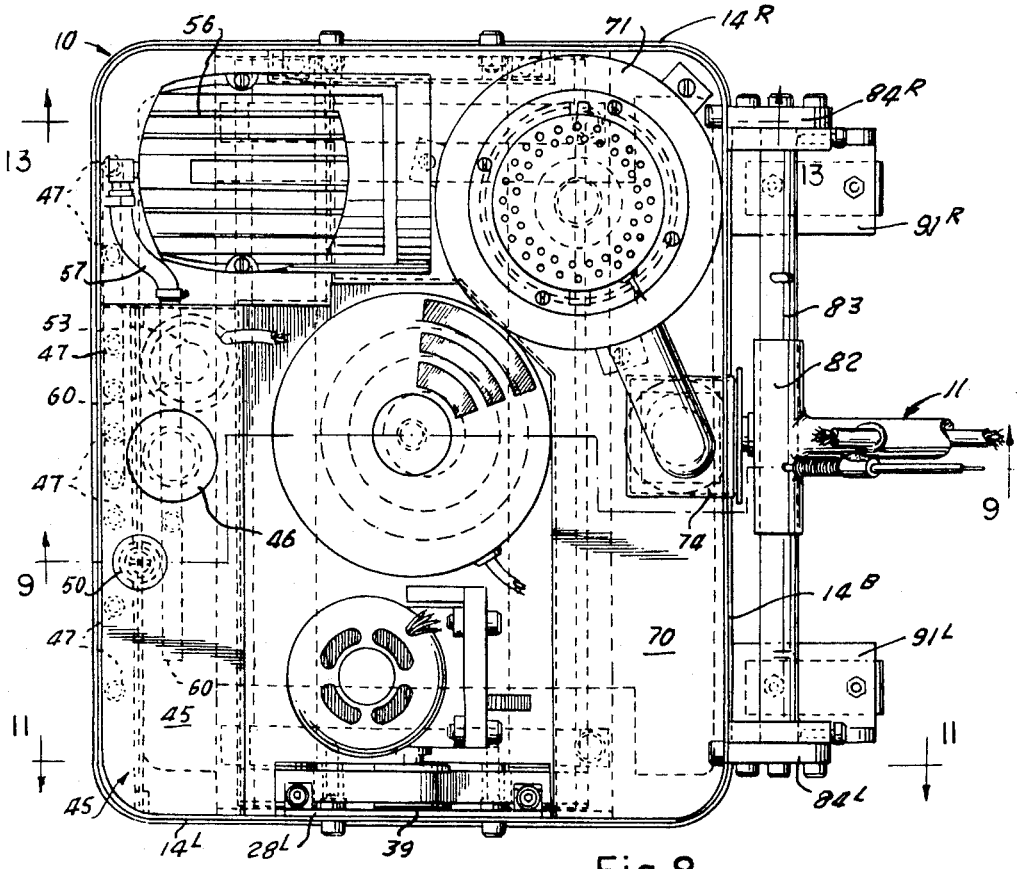
FIG. 8 is a view of the top of the machine, with the top cover removed.
Figure 4:
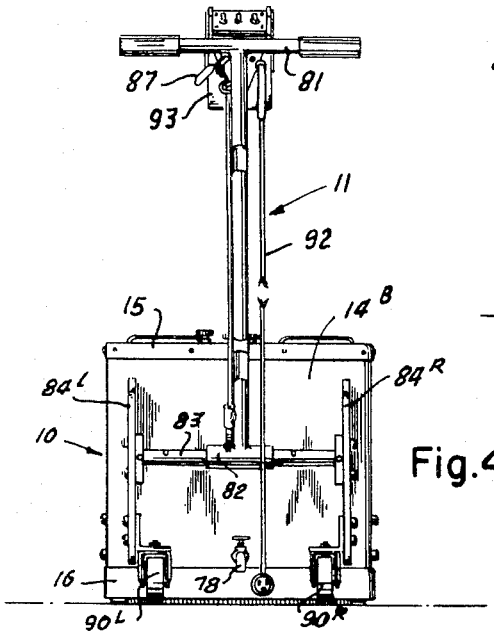
Figure 13:
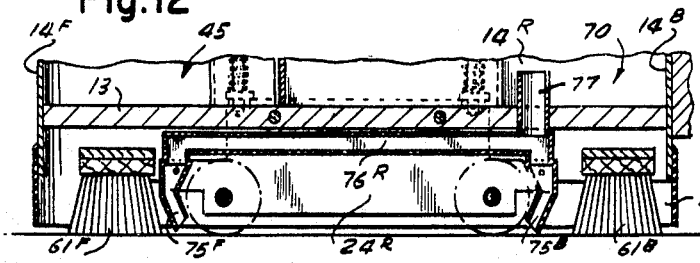
FIG. 13 is a fragmentary sectional view taken in the vertical plane 13—13 of FIG. 8, particularly illustrating the vacuum pickup nozzles and manifold.

The drive motor and gear box unit 36 for the drive rollers is best seen in FIGS 8 and 13, this unit being mounted on a bracket 37 supported on the floor plate 13. The horizontal output shaft 38 from the gear box extends toward the left side wall and carries a drive pulley 39 disposed in the plane of the drive roller pulleys 35. A drive belt 40 couples the drive pulley 39 and the roller pulleys 35, this belt also passing over an idler pulley 41 rotatably supported on the roller bracket 24L, so that the two drive rollers are driven simultaneously by the drive motor unit 36.

A solution dispensing system includes a supply tank 45 formed integrally with the housing 10 adjacent to the front and left sidewalls. This tank is a sealed tank extending to the top of the housing and includes a filler opening and cap 46 for supplying materials to the tank. The materials are dispensed from the tank through seven vertical dispenser tubes 47 laterally spaced along the front of the housing adjacent to the front wall, these tubes extending from a trough 48 formed at the upper portion of the tank 45 and downward through openings provided in the floor plate 13. The trough 48 is a horizontal trough formed by the front wall 14F, a horizontal bottom plate having openings communicating with the upper ends of the dispenser tubes 47, and a rear wall formed by a weir gate 49 supported for reciprocating vertical movement in plane parallel to the front wall. The weir gate is supported from a control helix 50 threaded through a threaded bushing in the top of the supply tank, and including a manual knob extending from the top of the housing for control by the operator. Through this control helix, the weir gate is raised or lowered to regulate the horizontal opening defined between the weir gate and the top of the tank which communicates the trough 48 with the remainder of the supply tank 45.

An electric motor-pump unit 53 is mounted within the supply tank 45 on the floor plate 13 for agitating and mixing the solution in the supply tank as desired.

Air for pressurizing the supply tank and for aerating and foaming the solution within the tank is provided from an air compressor-electric motor unit 56 mounted adjacent to the right front corner of the machine housing. The compressor outlet includes a flexible conduit 57 between the compressor and the supply tank, a conduit 58 within the tank including horizontal and vertical branches, and a horizontal T nozzle 59 providing two nozzle outlets 60. In operation, the solution in the tank is agitated by the motor-pump unit 53 and aerated by the compressor unit 56 to produce a foam which is caused to flow from the main tank chamber into the trough 48 as a result of the pressurization of the tank. The solution is then dispensed from the dispenser tubes 47 being discharged adjacent to the front wall 14F.

Figure 9:
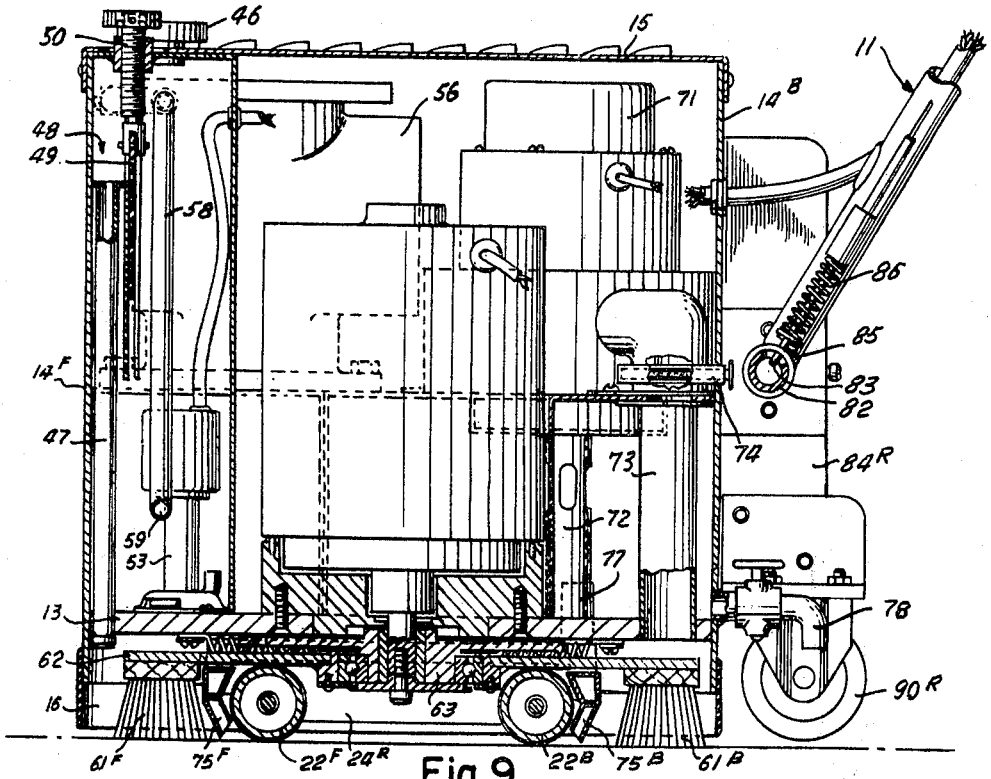
FIG. 9 is a sectional view taken in the vertical plane 9—9 of FIG. 8 looking from the left side of the machine.
Figure 10:
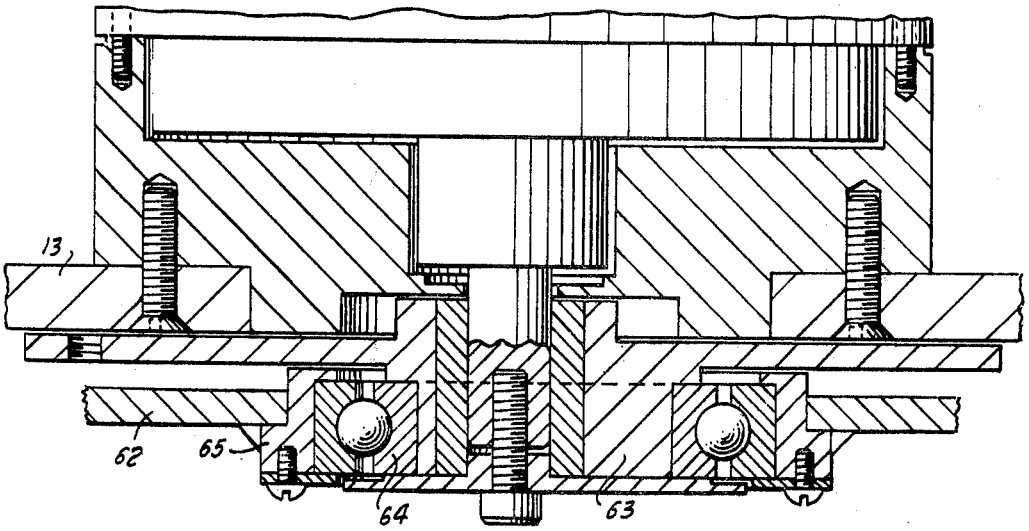
FIG. 10 is an enlarged fragmentary view of the brush drive mechanism illustrated in FIG. 9.

The working brushes for the machine are elongated front and rear brushes 61F and 61B, respectively, having downwardly extending bristles. The brushes are supported on a horizontal brush plate 62, supported just below the floor plate 15, with the brushes extending transversely parallel to and adjacent to the housing front and rear walls. The support end drive for the brushes is best seen in FIGS. 9 and 10 and also in FIG. 7.

The power unit for the brush system is a vertically disposed electric motor 67 supported at the center of the machine housing on the floor plate 13. The motor drive shaft extends downwardly through an opening in the floor plate, and has non-rotatably fixed thereto an eccentric drive plate 63 including a fly wheel portion and an eccentric boss. An antifriction rotation and thrust bearing 64 has its inner race secured to the eccentric boss; and a mounting collar 65 associated with the brush plate 62 is secured to the outer race of this bearing. In this manner, the brush plate 62 is secured to and partially supported by the eccentric drive plate 63.

Figure 7:
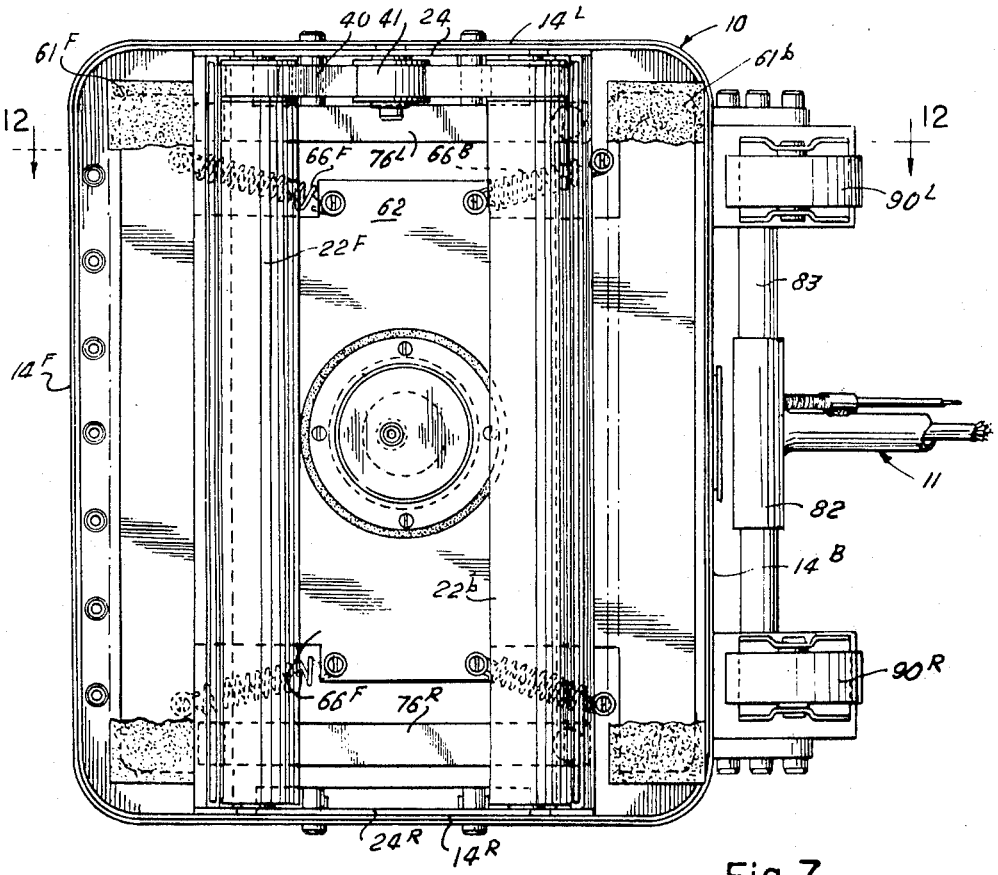
FIG. 7 is a view from the bottom of the machine of FIGS. 1 through 4.
Figure 3:
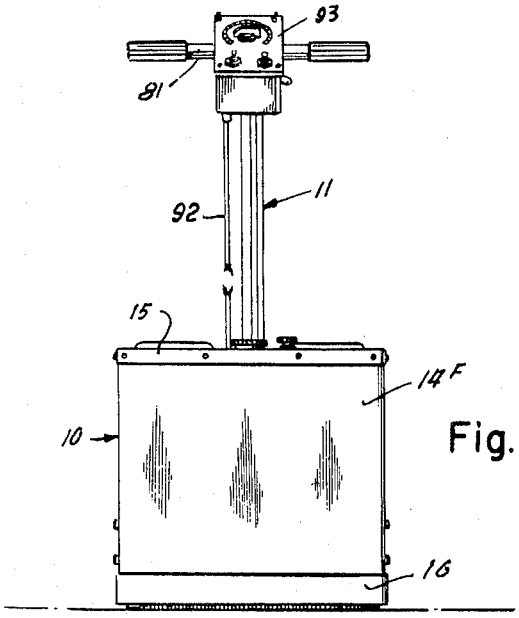
Figure 15:
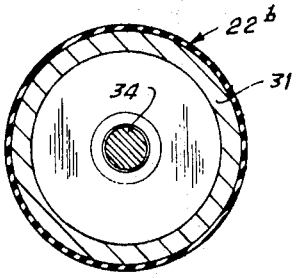
FIG. 15 is a sectional view of a support and drive roller as viewed in the plane 15—15 of FIG. 14.

As best seen in FIGS. 7 and 13, the brush plate is generally co-extensive with the floor plate of the machine housing; and the brush plate is further laterally supported by means of a pair of front tension springs 66F and a pair of rear tension springs 66B. The front springs 66F are anchored between the housing floor plate and the brush plate to urge the brush plate toward the front of the machine, while the rear springs 66B are connected between the floor plate and the brush plate to urge the brush plate toward the rear of the machine. The springs 66 then form a lateral suspension system for the brush plate to facilitate orbital drive of the brush plate and brushes 61 by the eccentric drive mechanism. As best seen in FIG. 9, the front brush 61F is spaced sufficiently from the housing front wall to permit the dispensing of the solution from the dispensing tubes 47 ahead of the front brush.

The vacuum pickup system for the machine includes a collection tank 70 which is formed integrally with the housing floor plate and rear wall, extending laterally across the machine. An electric motor-vacuum pump unit 71 is mounted on the collection tank at the right rear corner of the housing and includes an inlet pipe 72 which extends vertically through the tank. The inlet tube includes inlet openings at the upper end of the tube to withdraw air only from the upper portion of the collection tank 70. The vacuum pump discharge conduit 73 extends downwardly from the unit discharging through the floor plate 13 to the area beneath the floor plate enclosed by skirt 19. A filter unit 74 is provided within the outlet conduit including a filter element removable from a rear housing wall.

The machine is provided with an elongated front and rear vacuum nozzles 75F and 75B which extend laterally across the machine; the front nozzle 75F being disposed forwardly of the front drive roller 22F, and the rear vacuum nozzle 75B being disposed rearwardly of the rear drive roller 22B. The vacuum nozzles are connected at their ends to respective left and right manifolds 76L and 76R, each of these manifolds including an upright discharge pipe 77 which extends through the housing floor into the collection tank 70. In operation, the vacuum created within the collection tank 70 causes withdrawal of the foam or dirt from the floor surface through the nozzles 75 and the manifolds 76, which material is drawn into the lower portion of the tank. Since the discharge pipes 77 extend only a short distance above the housing floor surface, the discharge materials settle in the lower portion of the tank, and the relatively cleaner air is withdrawn from the tank through vacuum pump inlet tube openings adjacent to the top of the tank. A drain faucet 78 is provided for draining the collection tank.

The handle 11 is an elongated member including a T grip 81 at the outer end and a T base 82 in the form of a sleeve at the opposite end. The handle is coupled to the housing 10 by means of a transverse support pipe 83 non-rotatably mounted between left and right support brackets 84L and 84R secured to the housing rear wall. Since the machine is self-propelled, the handle is used for minimal machine guidance by the operator, and also to support the control panel for automatic control of the machine. For this purpose, the handle should be free to swivel on the support pipe 83 so that the T grip 81 may be held at a convenient height by the operator. For supporting the handle at a minimum height, the handle is provided with a latch pin 85 for engagement in a suitable angularly elongated recess in the support pipe 83. The pin mechanism is best illustrated in FIG. 9 which shows the latch pin 85 urged by a compression spring 86 into a pipe recess. A lever 87 at the grip end of the handle is coupled to the latch pin 85 through a cable or link for the purpose of releasing the latch pin when desired.

This handle latching feature is also desirable for the purpose of transporting the machine over floor surfaces from one area of use to another. For this purpose the machine housing is provided with a left and right transport wheels 90L and 90R rotatably supported on suitable wheel brackets 91L and 91R mounting on the housing rear wall. These transport wheels are mounted on the housing to be normally supported above the floor surface, and are engaged with the floor when the machine is tilted backward by means of the handle 11 wherein the machine is entirely supported on the transport wheels and conveniently moved by the operator to a different area for use.

Figure 6:
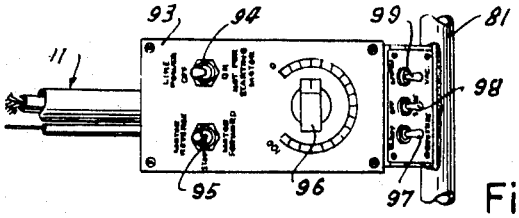

As indicated above, all of the powered elements for the machine are driven by electric motors; and electric energy is supplied through a conventional power cord 92 connected to a suitable control box and panel 93 mounted on the handle 11 adjacent to the T grip 81. As best seen in FIG. 6, the control panel includes a main line switch 94, a reversible motor switch 95 for controlling the direction of drive of the roller drive motor 36, and an associated rheostat 96 for controlling the speed of the drive motor. Other controls are an on-off switch 97 for the brush drive motor 67, an on-off switch 98 for the supply tank compressor and agitator pump motors, and an on-off switch 99 for the vacuum pump unit 71.

The operation of the above described machine for several of its functions will now be briefly described.

For scrubbing or shampooing a rug or a carpet, the supply tank 45 is first charged with the appropriate treatment materials such as a suitable proportion of water and liquid detergent. Prior to the cleaning operation, the agitator pump and compressor are turned on to appropriately mix the solution and create the desired foam, while simultaneously pressuring the supply tank to the desired pressure. During this operation, the weir gate may be moved to its upper closed position by the control helix 50 to prevent flow of the solution foam into the trough 48.

After positioning the machine to begin the cleaning operation, the weir gate is opened to effect the desired flow of detergent from the dispensing tubes, the brush drive motor is energized, and the roller drive motor is energized to propel the machine in a forward direction. The vacuum system is also energized. The machine moves forward at an appropriate rate of speed so that the cleaning solution, which is applied uniformly across the machine path from the several dispensing tubes 47, is worked into the rug pile by the orbiting forward brush 61F to effectively clean all surfaces of the pile fibers and to work the cleaning foam to the base of the pile.

As the forward drive roller 22F moves toward the scrubbed area, the squeegee action effected by the weight of the machine urges the foam forward toward the front vacuum pickup nozzle 75F. The rear vacuum pickup nozzle 75B picks up any materials from the surface which remain; and the orbiting rear brush 61B effects a circular swirling action of the pile fibers to lift the pile to its original as-new position. The air circulated by the vacuum system is returned to the underside of the housing through the discharge tube 73, after being filtered, to effect a continuous circulation of air to assist in the drying of the surface enclosed within the machine skirt 16.

For a hard floor surface scrubbing or wax stripping operation, the machine functions in a similar manner. For this operation the forward operating brush 61F would be a different type of brush for performing a desired scrubbing or stripping operation; and a rear brush 61B would not be required.

For a floor waxing operation, a relatively quick drying foam wax solution may be dispensed to the floor surface with the same foaming and dispensing system, the forward brush 61F may be particularly adapted for distributing the wax foam uniformly over the floor surface. The vacuum system may be operated as an air circulating system wherein the air is directed to the area enclosed by the machine walls 14 and skirt 16 and recirculated through the vacuum pickup nozzles 75F and 75B to assist in the drying of the wax. The rear brush 61B then may be a polishing brush for applying a final polish to the floor surface.

What has been described is an improved floor treatment machine which is particularly adapted for the shampooing of rugs or carpeted floor surfaces including the application of a shampoo foam and the pickup of the shampoo entrained dirt in one continuous operation.

An important feature of the invention is the system for containing a supply of liquid cleaning medium, for producing a foam of the cleaning medium, and for selectively controlling the flow of the foam from the supply tank to the floor surface. A particular feature of this system is that the solution is agitated and foam created in a pressurized main chamber, with the foam moving under air pressure from the supply tank main chamber to a dispensing chamber under control of an adjustable weir gate, with the foam being further dispensed from the dispensing chamber to the floor surface at a controlled rate under pressure.

While a preferred embodiment of the invention has been illustrated and described, it will be understood by those skilled in the art that changes and modifications may be resorted to without departing from the spirit and scope of the invention.

What is claimed is:

1. A machine for treating floor surfaces comprising a housing having front and rear ends in relation to normal movement over a floor surface in one direction;

means mounted on said housing for supporting said housing for movement along the floor surface;

supply means in said housing for supplying a cleaning foam; brush means mounted under said housing; power means in said housing for producing movement of said brush means in the floor plane, relative to said housing;

said cleaning foam supply means including; a supply tank in said housing having a main chamber for containing a liquid solution, means in said main chamber for producing a foam of the solution therein, including a source of compressed air communicating with said tank main chamber for pressurizing said tank and for aerating said solution to produce said foam, elongated transverse trough means in said tank defining a dispensing chamber, adjustable gate means for regulating the flow of solution foam from said supply tank main chamber into said dispensing chamber and dispensing means disposed at the front end of said housing communicating with said dispensing chamber for dispensing cleaning foam onto said floor surface.

2. A machine as set forth in claim 1 further comprising said foam producing means further including means in said supply tank main chamber for agitating and mixing the solution therein.

3. A machine as set forth in claim 2 further comprising said agitating and mixing means including an agitating pump.

4. A machine as set forth in claim 1 further comprising said foam producing means including air nozzle means communicating with said compressed air source.

5. A machine as set forth in claim 4 further comprising said compressed air source comprising an air pump mounted in said housing and supplying pressurized air to said nozzle means.

6. A machine as set forth in claim 1 further comprising said dispensing means defining a plurality of laterally spaced foam dispensing passages.

7. A machine as set forth in claim 1 further comprising said elongated dispensing chamber trough being disposed in the upper portion of said supply tank; a plurality of vertical conduits connected to said trough defining said dispensing means; and said adjustable gate means comprising an adjustable weir gate for controlling the flow of solution foam from the supply tank main chamber to said dispensing chamber.

8. A machine as set forth in claim 1 further comprising said adjustable gate means comprising an adjustable weir gate; and control means externally of said tank for adjusting the position of said weir gate within said tank.

* * * * *